US009732953B2

(12) United States Patent
Pisavadia et al.

(10) Patent No.: US 9,732,953 B2
(45) Date of Patent: Aug. 15, 2017

(54) LED LUMINAIRE WITH MULTIPLE VENTS FOR PROMOTING VERTICAL VENTILATION

(71) Applicant: ABL IP Holding LLC, Conyers, GA (US)

(72) Inventors: Sachin Pisavadia, Milton Keynes (GB); Christopher Wilkes, Buckinghamshire (GB)

(73) Assignee: ABL IP Holding LLC, Decatur, GA (US)

( * ) Notice: Subject to any disclaimer, the term of this patent is extended or adjusted under 35 U.S.C. 154(b) by 344 days.

(21) Appl. No.: 14/286,022

(22) Filed: May 23, 2014

(65) Prior Publication Data

US 2014/0347848 A1 Nov. 27, 2014

(30) Foreign Application Priority Data

May 24, 2013 (EP) ..... 13169233

(51) Int. Cl.
*F21V 29/00* (2015.01)
*F21S 8/04* (2006.01)
(Continued)

(52) U.S. Cl.
CPC ..... *F21V 29/004* (2013.01); *F21K 9/20* (2016.08); *F21S 8/04* (2013.01); *F21S 8/06* (2013.01);
(Continued)

(58) Field of Classification Search
CPC ..... F21K 9/135; F21K 9/00; F21V 29/004; F21V 3/02; F21V 29/74; F21Y 2103/022
(Continued)

(56) References Cited

U.S. PATENT DOCUMENTS 6,200,007 B1 3/2001 Minissi et al.
6,491,413 B1 12/2002 Benesohn
(Continued)

FOREIGN PATENT DOCUMENTS

CN 201126125 10/2008
CN 201748298 2/2011
(Continued)

OTHER PUBLICATIONS

Extended European Search Report for European Patent Application No. EP13169233.7, mailed Oct. 18, 2013, 7 pages.
(Continued)

*Primary Examiner* — William Carter
(74) *Attorney, Agent, or Firm* — Kilpatrick Townsend & Stockton, LLP

(57) ABSTRACT

Some features of the invention include a LED luminaire, including a chassis having a chassis body, the chassis body having an inner perimeter and an outer perimeter. At least one LED lighting module is mounted on the chassis body. A LED power supply assembly includes at least one LED power supply unit for the at least one LED lighting module. The LED luminaire further includes at least one inner perimeter vent interposed between the chassis body and the LED power supply assembly to thermally separate the chassis body from the LED power supply assembly. Outer perimeter vents may be located along the outer perimeter. The inner and outer perimeter vents promote the natural flow of air around and through the LED luminaire to remove heat generated by the at least one LED lighting module and/or LED power supply assembly. In certain features, the LED power supply assembly includes top and bottom vent covers, and the at least one LED power supply unit is located between the top and bottom vent covers. The top and bottom vent covers are vented to promote the natural flow of air
(Continued)

through the LED power supply assembly, further removing heat generated by the at least LED one power supply unit. Yet other features include a shaped optic covering the at least one LED lighting module and that further promotes the natural flow of air around and through the LED luminaire.

15 Claims, 14 Drawing Sheets

(51) Int. Cl.

| | |
|---|---|
| ***F21S 8/06*** | (2006.01) |
| ***F21V 23/02*** | (2006.01) |
| ***F21V 29/74*** | (2015.01) |
| ***F21V 29/83*** | (2015.01) |
| ***F21K 9/20*** | (2016.01) |
| *F21Y 115/10* | (2016.01) |

(52) U.S. Cl.
CPC ..... *F21V 23/02* (2013.01); *F21V 29/74* (2015.01); *F21V 29/83* (2015.01); *F21Y 2115/10* (2016.08)

(58) Field of Classification Search
USPC ..... 362/373
See application file for complete search history.

(56) References Cited

U.S. PATENT DOCUMENTS

| | | | | |
|---|---|---|---|---|
| 6,669,355 | B2 | 12/2003 | Layne et al. | |
| 7,500,760 | B2 | 3/2009 | Byrne | |
| 7,611,264 | B1 | 11/2009 | Chang et al. | |
| 7,628,513 | B2 | 12/2009 | Chiu | |
| 7,828,465 | B2 | 11/2010 | Roberge et al. | |
| 7,866,850 | B2 | 1/2011 | Alexander et al. | |
| 7,891,842 | B2 | 2/2011 | Lu et al. | |
| 7,972,054 | B2 | 7/2011 | Alexander et al. | |
| 8,066,392 | B2 | 11/2011 | Wang | |
| 8,152,336 | B2 | 4/2012 | Alexander et al. | |
| 8,164,237 | B2 | 4/2012 | Wen | |
| 8,177,395 | B2 | 5/2012 | Alexander et al. | |
| 8,246,213 | B2 | 8/2012 | Fu et al. | |
| 8,256,934 | B2 | 9/2012 | Cunius | |
| 8,272,765 | B2 | 9/2012 | Ter-Hovhannisyan | |
| 8,322,892 | B2 | 12/2012 | Scordino et al. | |
| 9,441,634 | B2 | 9/2016 | Spiro | |
| 2002/0044446 | A1 | 4/2002 | Layne et al. | |
| 2008/0212333 | A1 | 9/2008 | Chen | |
| 2009/0135613 | A1 | 5/2009 | Peng | |
| 2009/0296387 | A1 | 12/2009 | Reisenauer et al. | |
| 2010/0002452 | A1 | 1/2010 | Gananathan et al. | |
| 2010/0026158 | A1 | 2/2010 | Wu | |
| 2010/0172143 | A1* | 7/2010 | Cunius | F21S 8/04 362/373 |
| 2011/0037368 | A1 | 2/2011 | Huang | |
| 2011/0181167 | A1 | 7/2011 | Cho et al. | |
| 2011/0193463 | A1* | 8/2011 | Daniel | F21V 29/004 313/46 |
| 2012/0033419 | A1 | 2/2012 | Kim et al. | |
| 2012/0075860 | A1 | 3/2012 | Choi | |
| 2012/0087137 | A1 | 4/2012 | Lay et al. | |
| 2012/0176797 | A1 | 7/2012 | Stolte et al. | |
| 2012/0236565 | A1 | 9/2012 | Wu | |
| 2013/0010463 | A1 | 1/2013 | Li et al. | |
| 2013/0010464 | A1* | 1/2013 | Shuja | F21V 29/402 362/235 |
| 2013/0044478 | A1* | 2/2013 | Steedly | F21V 3/049 362/235 |
| 2017/0045215 | A1 | 2/2017 | Spiro | |

FOREIGN PATENT DOCUMENTS

| | | |
|---|---|---|
| CN | 202432313 | 9/2012 |
| CN | 202493997 | 10/2012 |
| CN | 202902088 | 4/2013 |
| EP | 2442021 | 4/2012 |
| JP | 2002367406 | 12/2002 |
| JP | 2008098020 | 4/2008 |
| JP | 2012104476 | 5/2012 |
| KR | 101215598 | 12/2012 |
| WO | 2010035996 | 4/2010 |
| WO | 2010137792 | 12/2010 |
| WO | 2013058377 | 4/2013 |

OTHER PUBLICATIONS

Office Action for European Patent Application No. EP 13169233.7, mailed Jun. 10, 2016, 5 pages.

* cited by examiner

LED LUMINAIRE WITH MULTIPLE VENTS FOR PROMOTING VERTICAL VENTILATION

CROSS-REFERENCE TO RELATED APPLICATIONS

This application claims priority to European patent application no. EP 13169233.7, filed on May 24, 2013 and titled "LED Luminaire with Multiple Vents for Promoting Vertical Ventilation," the contents of which are hereby incorporated by reference.

FIELD OF THE INVENTION

The present invention relates to luminaires, and more particularly to LED luminaires having improved heat transfer characteristics.

BACKGROUND

Light emitting diodes ("LED") used in LED luminaires generate a great deal of heat during operation, which, if not transferred from the LEDs, can detrimentally impact the efficiency of the LEDs and compromise the operation and longevity of other LED luminaire components, including the power sources and other electronic components for such LEDs.

Known LED luminaires incorporate a mechanical heat sink located proximate the LED lighting unit and/or LED power supply unit to draw heat away from these components by conduction. The heat sink is exposed to ambient air and heat conducted to the heat sink dissipates over time. The heat removal efficiency is decreased, however, where the air above and/or below the LED luminaire is stagnant. A LED luminaire providing improved heat transfer characteristics would thus be desirable.

FEATURES OF THE INVENTION

Features of the invention include:

A) A light-emitting diode (LED) luminaire comprising:

a. a chassis comprising a chassis body;

b. at least one LED module mounted on the chassis body; and c. an LED power supply assembly comprising at least one LED power supply unit for the at least one LED lighting module, characterized in that the chassis body has an inner perimeter and an outer perimeter, and the LED luminaire further comprises at least one inner perimeter vent interposed between the chassis body and the LED power supply assembly to thermally separate the chassis body from the LED power supply assembly.

B) The LED luminaire according to Feature A, wherein an opening is defined within the chassis body and wherein the LED power supply assembly is positioned within the opening.

C) The LED luminaire according to Features A or B, wherein the at least one inner perimeter vent comprises a plurality of inner perimeter vents located around the inner perimeter of the chassis body.

D) The LED luminaire according to any one of Features A to C, wherein the chassis further comprises a plurality of outer perimeter vents extending along the outer perimeter of the chassis body.

E) The LED luminaire according to Feature D, wherein at least one of the outer perimeter or inner perimeter of the chassis body is circular.

F) The LED luminaire according to any one of Features D or E, wherein the chassis further comprises a plurality of fins located on the chassis body, each of the plurality of fins comprising a proximal end and a distal end, wherein the inner perimeter vents are formed by connecting the proximal ends of adjacent fins and the outer perimeter vents are formed by connecting the distal ends of adjacent fins.

G) The LED luminaire according to any one of Features A to F, wherein the LED power supply assembly further comprises a top vent cover located above the at least one LED power supply unit and a bottom vent cover located below the at least one LED power supply unit, wherein the top vent cover and bottom vent cover are vented so as to allow natural flow of air through the LED power supply assembly.

H) The LED luminaire according to any one of Features A to G, wherein the at least one LED lighting module comprises at least one LED mounted on a printed circuit board and wherein the at least one LED lighting module is shaped.

I) The LED luminaire according to any one of Features A to H, further comprising an optic positioned over the at least one LED lighting module, wherein the optic comprises a semi-torus shape.

J) The LED luminaire according to any one of Features B to I, wherein the chassis is semi-toroidal shaped and the opening is circular.

K) An LED luminaire comprising a chassis and a LED power supply assembly thermally separated from the chassis, characterized in that the LED power supply assembly comprises a top vent cover, a bottom cover and at least one LED power supply unit located between the top vent cover and the bottom vent cover, wherein the top vent cover and bottom vent cover are vented so as to allow the natural flow of air through the LED power supply assembly.

L) The LED luminaire according to Feature K, wherein the chassis comprises at least one vent and at least one LED lighting module powered by the at least one LED power supply unit, the at least one vent configured to promote the natural flow of air around the LED luminaire and/or through the at least one vent so as to remove heat generated by the at least one LED lighting module and/or the at least one LED power supply unit.

M) The LED luminaire according to Feature L, wherein the LED power supply assembly is thermally separated from the chassis by the at least one vent.

N) The LED luminaire according to any one of Features K to M, wherein an opening is defined within the chassis and the LED power supply assembly is positioned within the opening.

BRIEF DESCRIPTION OF THE DRAWINGS

Illustrative features of the present invention are described in detail below with reference to the following drawing figures.

DETAILED DESCRIPTION

Figure 1:
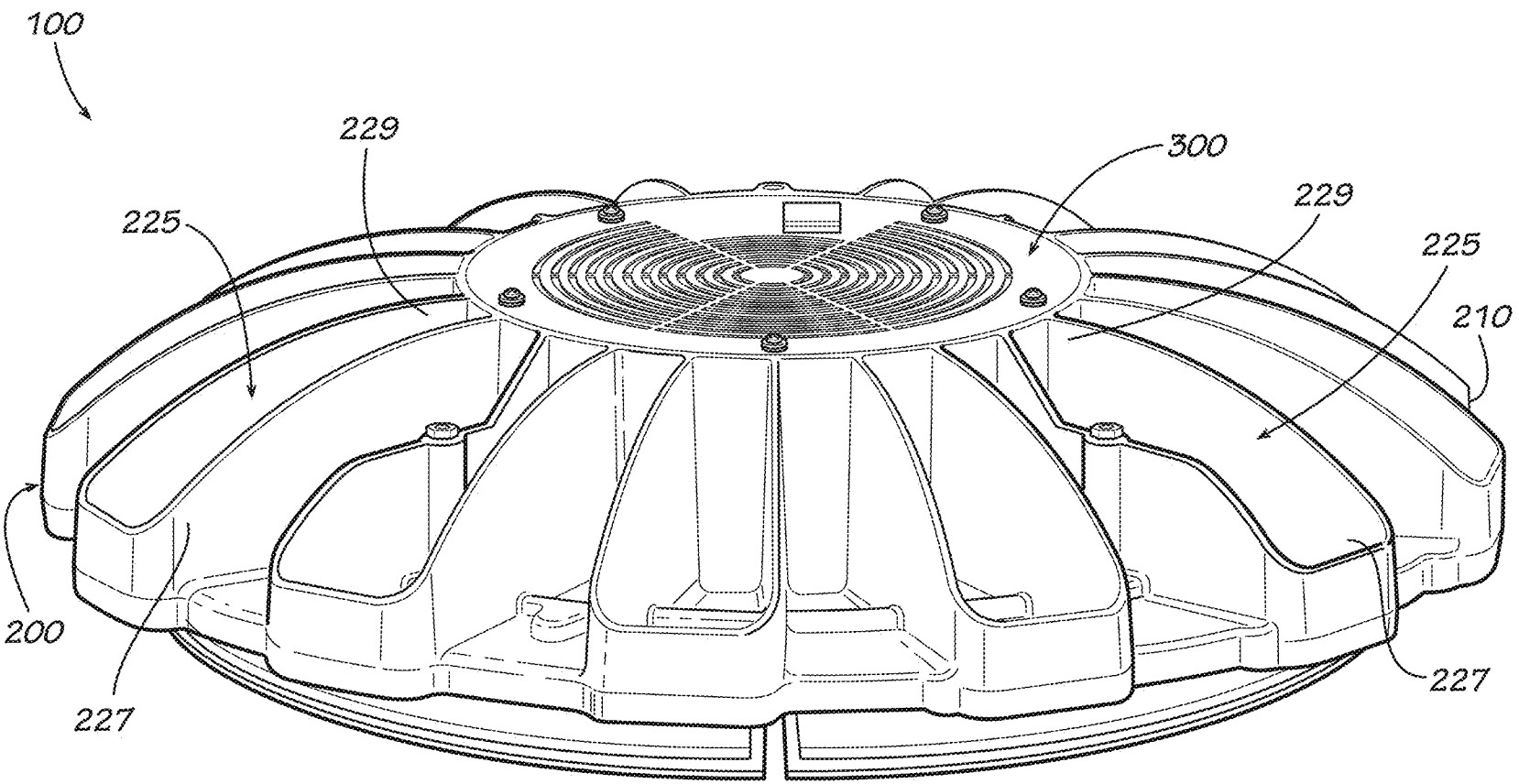
FIG. 1 is a top perspective view of a LED luminaire according to one feature of the invention.

The subject matter of features of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

With reference to FIGS. 1-8A, certain features of the invention include a LED luminaire 100 having a chassis 200, at least one LED lighting module 220 mounted to the chassis 200, and a LED power supply assembly 300.

As shown in the figures, the chassis body 210 may have a semi-toroidal shaped (e.g., donut-shaped) configuration, with a segmented circular outer perimeter 213 and central opening 215 defining an inner perimeter 217. The central opening 215 can receive the LED power supply assembly 300, as described in more detail below. It will be recognized, however, that other shapes and configurations for the chassis body 210 may be used. Purely by way of example, the chassis body 210 may have an oval, square, rectangular or even triangular shape and include an opening towards the center of the chassis to receive the LED power supply assembly 300.

At least one LED lighting module 220 is mounted to the underside of the chassis body 210. The at least one LED lighting module 220 may include a printed circuit board 222 populated with a plurality of LEDs 224. In some embodiments, the at least one LED lighting module 220 includes a single LED lighting module. In other embodiments, the at least one LED lighting module 220 includes two or more LED lighting modules. In yet other embodiments, the at least one LED lighting module 220 includes a plurality of LED lighting modules. As shown in the non-limiting embodiment of FIG. 5, a plurality of arc-shaped LED lighting modules 220 are arranged in a circular configuration on the chassis body 210 around the central opening 215.

An optic 280 may be positioned over the at least one LED lighting module 220. The optic 280 will be described in more detail below. One or more gaskets 230 may be positioned between the chassis body 210 and optic 280 to seal the at least one LED lighting module 220 within the optic 280 and thereby protect it from moisture, bugs and other undesirable environmental conditions.

Figure 2:
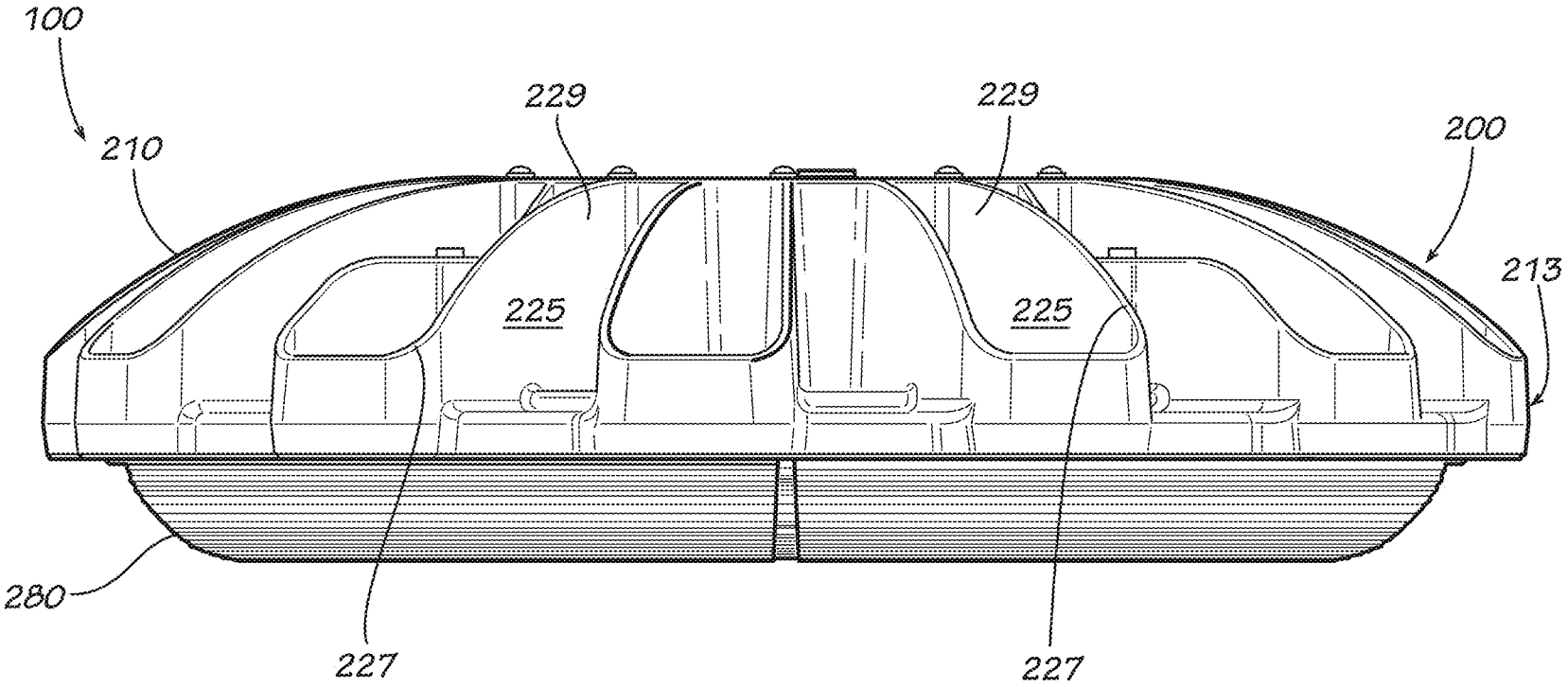
FIG. 2 is a side view of the LED luminaire according to FIG. 1.
Figure 3:
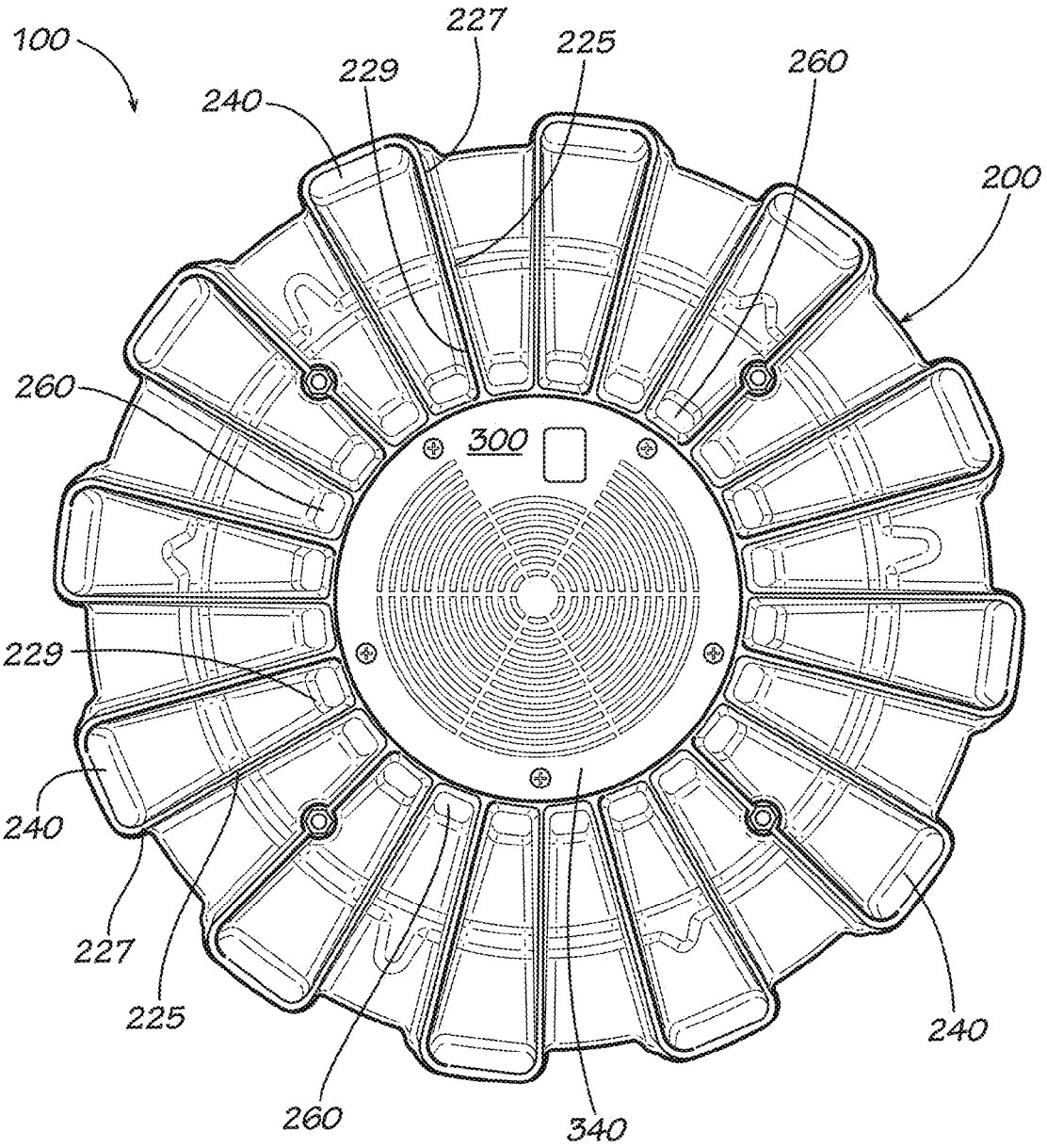
FIG. 3 is a top view of the LED luminaire according to FIG. 1.
Figure 4:
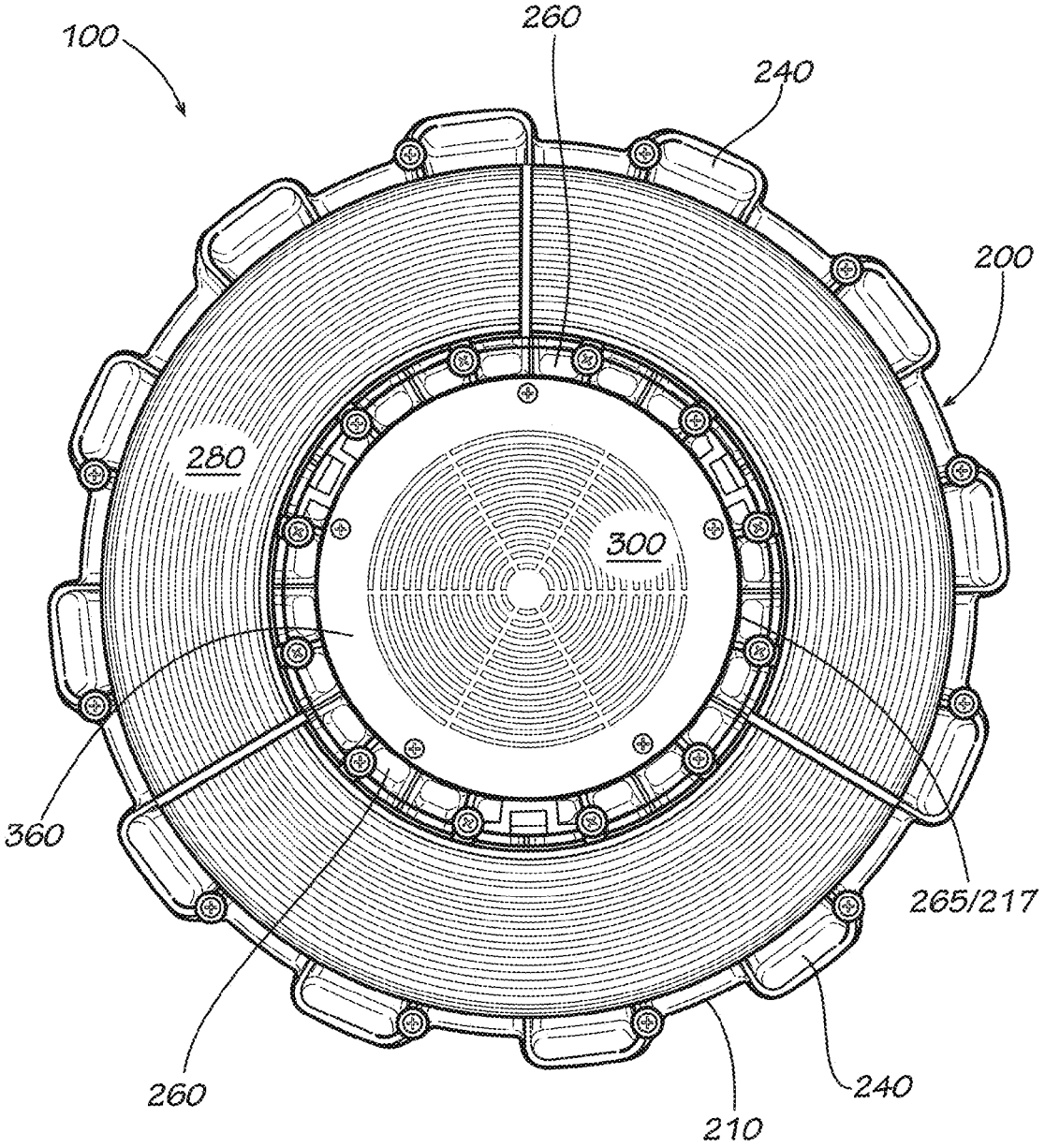
FIG. 4 is bottom view of the LED luminaire according to FIG. 1.

The chassis 200 acts as a heat sink in the LED luminaire 100 to dissipate heat from the LED luminaire 100. In addition, a plurality of fins 225 are provided on the chassis body 210 to increase the available surface area for dissipation of heat generated by the at least one LED lighting module 220. By way only of example, a plurality of fins 225 may radiate outwardly along the chassis body 210, as shown in FIGS. 1-3. As illustrated, alternating pairs of adjacent fins 225 may be joined at their distal ends 227 to form openings that function as outer perimeter vents 240 that extend along the outer perimeter 213 of the chassis body 210. Purely by way of example, these figures show a chassis body 210 having twenty-four (24) fins 225, each of which is joined at its distal end 227 to a distal end of an adjacent fin 225 to form twelve (12) outer perimeter vents 240. It will be recognized, however, that any number of fins 225 and outer perimeter vents 240 may be utilized, depending on desired aesthetic and performance characteristics.

As shown in the figures, the fins 225 radiate outward from the opening 215 of the chassis 200. The proximal ends 229 of the fins 225 converge towards the opening 215. The proximal ends 229 of the fins 225 may be connected to one another by an inner ring 265 or otherwise, forming a plurality of openings that function as inner perimeter vents 260 extending along the inner perimeter 217 of the chassis body 210.

The chassis 200 may be an integrally-formed body in that any or all of the chassis body 210, fins 225, or other structures forming vents 240, 260, may be formed integrally. However, such is certainly not required and it is contemplated that the various features of the chassis 200 could be formed separately and assembled together. The chassis 200 may be formed from any suitable material selected for its aesthetic and performance characteristics. Exemplary, not-limiting, examples of such materials include die-cast steel, aluminum and polymeric materials.

The outer perimeter vents 240 and the inner perimeter vents 260 provide flow paths for air to pass through (and not just around) the LED luminaire 100. During operation of the LED luminaire 100, heat is generated by the at least one LED lighting module 220 and power supply assembly 300, causing the air around the LED luminaire to be warmer than the air above and below the LED luminaire 100. The cooler air below the LED luminaire 100 is naturally drawn upwards towards the warmer air within and around the LED luminaire 100. Such cooler air is permitted to pass through the LED luminaire 100 via vents 240, 260. The additional air flow paths formed by vents 240, 260 facilitate cooling of the LED luminaire 100 and its components by way of natural convection.

Furthermore, the inner perimeter vents 260 help to thermally isolate components of the LED luminaire 100 and thereby control the temperature of such components. During operation of the LED luminaire 100, heat generated by the at least one LED lighting module 220 is conducted to the chassis 200 (acting as a heat sink). The gaps resulting from the inner perimeter vents 260 thermally separate and create a thermal barrier between the chassis body 210 and LED power supply assembly 300, rendering it more difficult for heat from one component to dissipate into the other component. More specifically, the reduced material connecting the chassis body 210 and LED power supply assembly 300 and the movement of air through inner perimeter vents 260 between these two components helps to reduce the heat that is transferred from the chassis body 210 to the LED power supply assembly 300 (and vice versa), thus resulting in a lower LED power supply assembly 300 and LED power supply unit 320 temperatures, helping to prolong the service life of the at least one LED power supply unit 320.

An exemplary LED power supply assembly 300 and related components is shown in FIGS. 5-8A. In some features, the LED power supply assembly 300 includes one or more LED power supply units 320, a top vent cover 340 located above the one or more LED power supply units 320 and a bottom vent cover 360 located below the one or more LED power supply units 320. In some embodiments, the one or more LED power supply units 320 are mounted on a bracket 380 between the top vent cover 340 and bottom vent cover 360, and the top vent cover 340 and bottom vent cover 360 are attached to the chassis 200 within the opening 215 by way of fasteners such as screws. In other embodiments (not illustrated), the LED power supply assembly 300 may include a housing which encloses the one or more LED power supply units 320 and to which the top vent cover 340 and bottom vent cover 360 are attached. In such features, the housing (and thus the LED power supply assembly 300) may be attached to the chassis 200 at the inner ring 265.

In certain embodiments, the one or more LED power supply units 320 may include a single LED power supply unit (e.g., an LED driver). It will be understood, however, that depending on the power requirements of the at least one LED lighting module 220, the LED power supply assembly 300 could include more than two LED power supply units or more than three LED power supply units. The LED power supply units could have various shapes.

According to embodiments of the invention, the top vent cover 340 and bottom vent cover 360 of the LED power supply assembly 300 are vented to allow air to freely pass through the LED power supply assembly 300 and remove heat generated therein. The vents allow air to flow in and out of the LED power supply assembly 300 with the least possible resistance because the natural direction of heated air is to rise vertically. Thus, placement of the entry and exit points for the air in its natural traveling direction minimizes restriction in air flow, allowing a larger volume of air to pass through the LED power supply assembly 300 than if the ventilation slots were orientated in another way. The larger the volume of air flowing past the one or more LED power supply units 320, the greater the heat transfer from the one or more LED power supply units 320 to the ambient air via natural convection, thus prolonging the service life of the one or more LED power supply units 320 and resulting in greater product performance and greatly reduced maintenance intervals. In addition, because generated heat is removed more efficiently, the LED luminaire can be operated in higher ambient temperatures than previously known LED luminaires.

Figure 5:
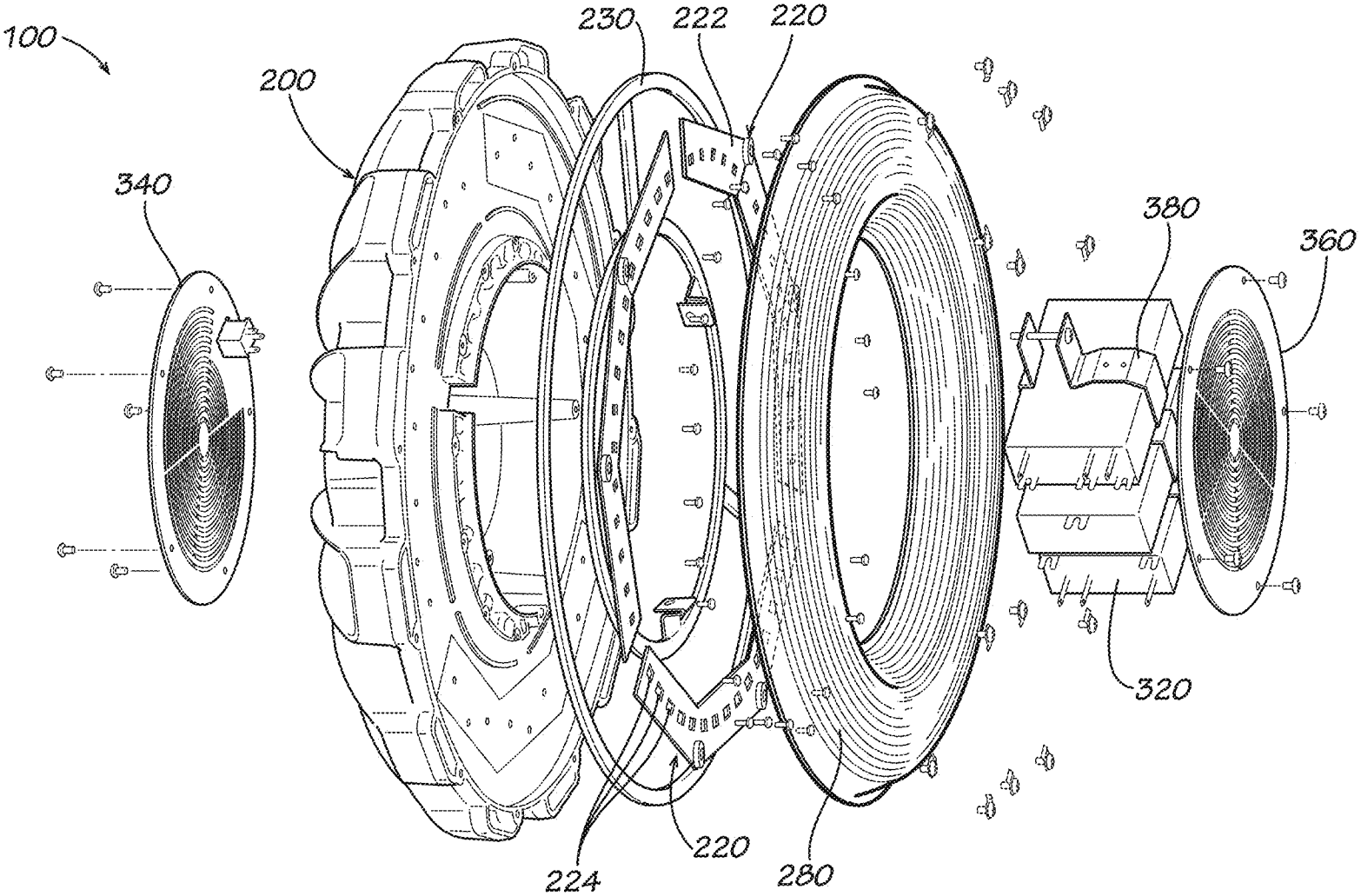
FIG. 5 is an exploded side perspective view of the LED luminaire according to FIG. 1.
Figure 6:
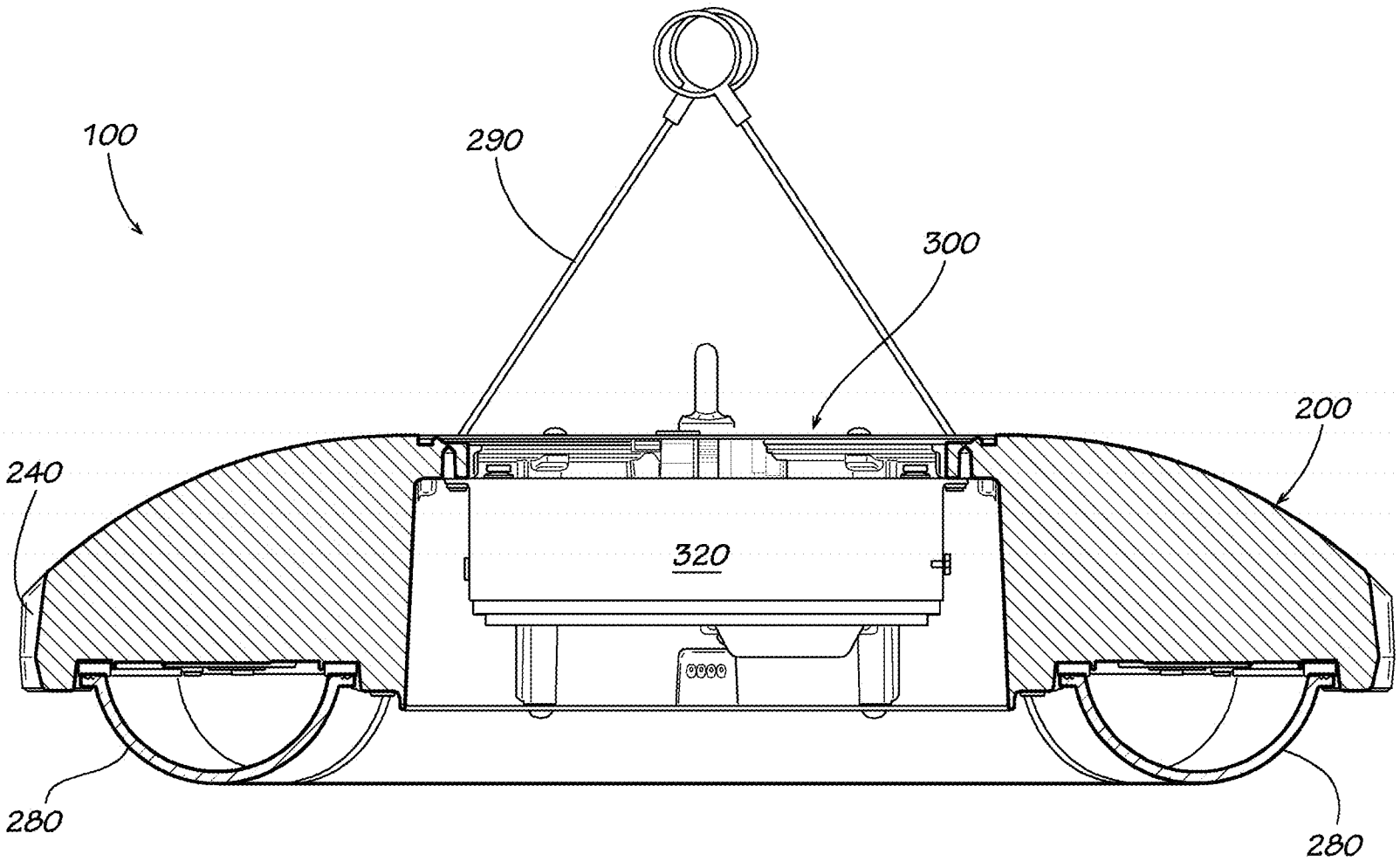
FIG. 6 is a side cross section view of the LED luminaire according to FIG. 1.
Figure 7:
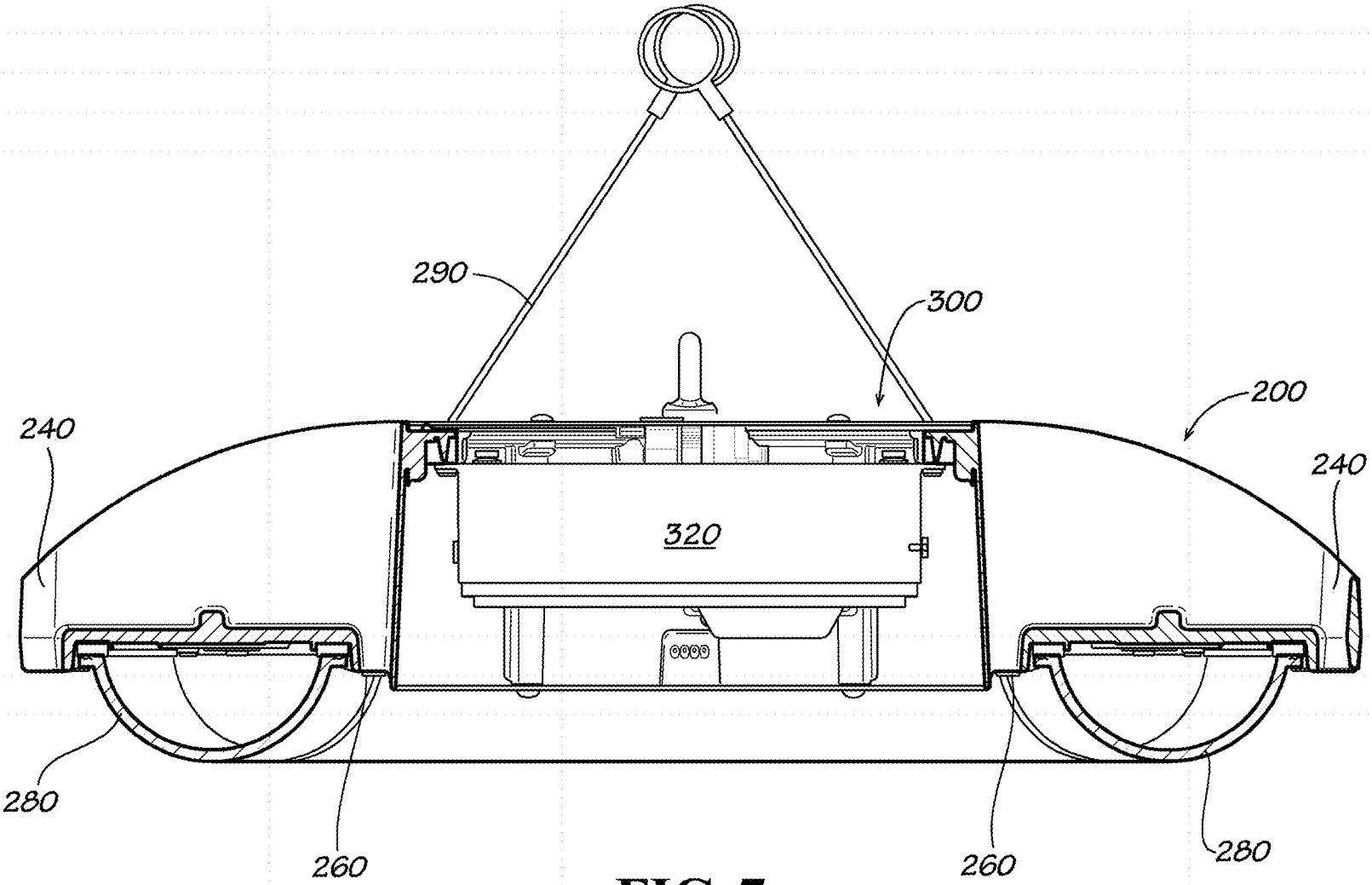
FIG. 7 is side cross section view of a LED luminaire according to certain features of the invention.
Figure 8:
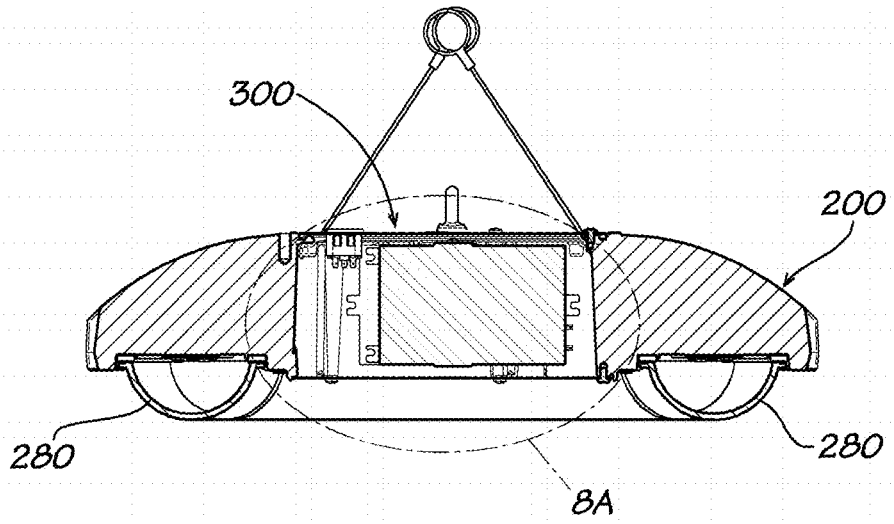
FIG. 8 is another side cross section view of the LED luminaire according to FIG. 7.
Figure 8A:
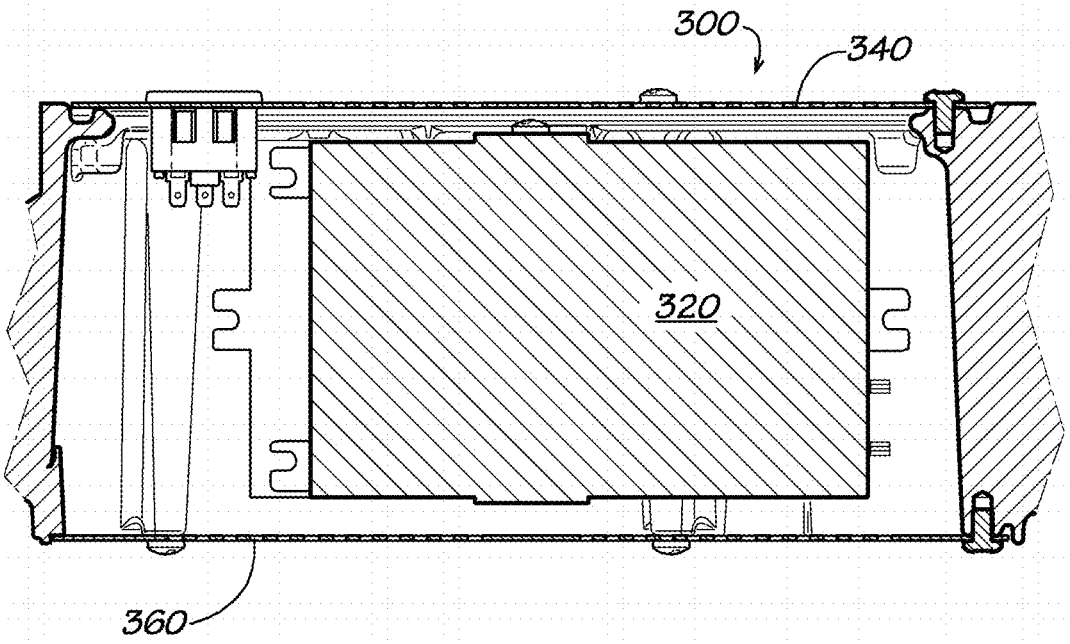
FIG. 8A is partial side cross section view of the LED luminaire according to FIG. 8.

Embodiments of the invention relate to the configuration of the optic 280. As shown in the figures, and as best seen in FIGS. 5-7, the optic 280 is curved in a "semi-torus" shape. The optic provides optical distribution of light emitted by the at least one LED lighting module 220 located between the optic 280 and chassis 200. When powered, the heat generated by the at least one LED lighting module 220 is transferred to the ambient air by natural convection of air around and through the LED luminaire 100, as described above. Specifically, the heat generated above the LED luminaire 100 draws cooler and denser air from underneath the LED luminaire 100 to accelerate the air around and through the LED luminaire (i.e., through the outer perimeter vents 240 and inner perimeter vents 260), thus applying air pressure on the surface of the optic 280 to help prevent dust particles from depositing on the optic 280 and removing those that do. This provides a distinct improvement over previously known LED luminaires, and in particular LED luminaires, in which the light output decreased over time due to the build-up of dust particles on the surface of the optic, thus blocking the light emitted from the lighting module(s).

The optic 280 may be formed from any suitable material, such as but not limited to glass, prismatic glass or a clear polymeric material. The optic may also be frosted or have other surface features to redirect or otherwise filter the light emitted from the at least one LED lighting module 220. Further, while the optic 280 is shown in the figures as having three discrete sections, it will be understood that the optic could be formed in one or two sections or have more than three sections.

As explained above, various features of the present invention, including but not limited to the vented LED power supply assembly 300, outer perimeter vents 240, inner perimeter vents 260 and curved optic 280, contribute to natural convection of air around and through the LED luminaire 100, which provides greatly improved heat dissipation characteristics as compared to previously known LED luminaires. A visual representation of temperatures and air flow around a LED luminaire incorporating features of the invention is illustrated in the simulated computational fluid dynamics ("CFD") models shown in FIGS. 9-11 and 14. In these models, lighter shading represents higher temperatures and faster fluid (air) flow velocities.

Figure 9:
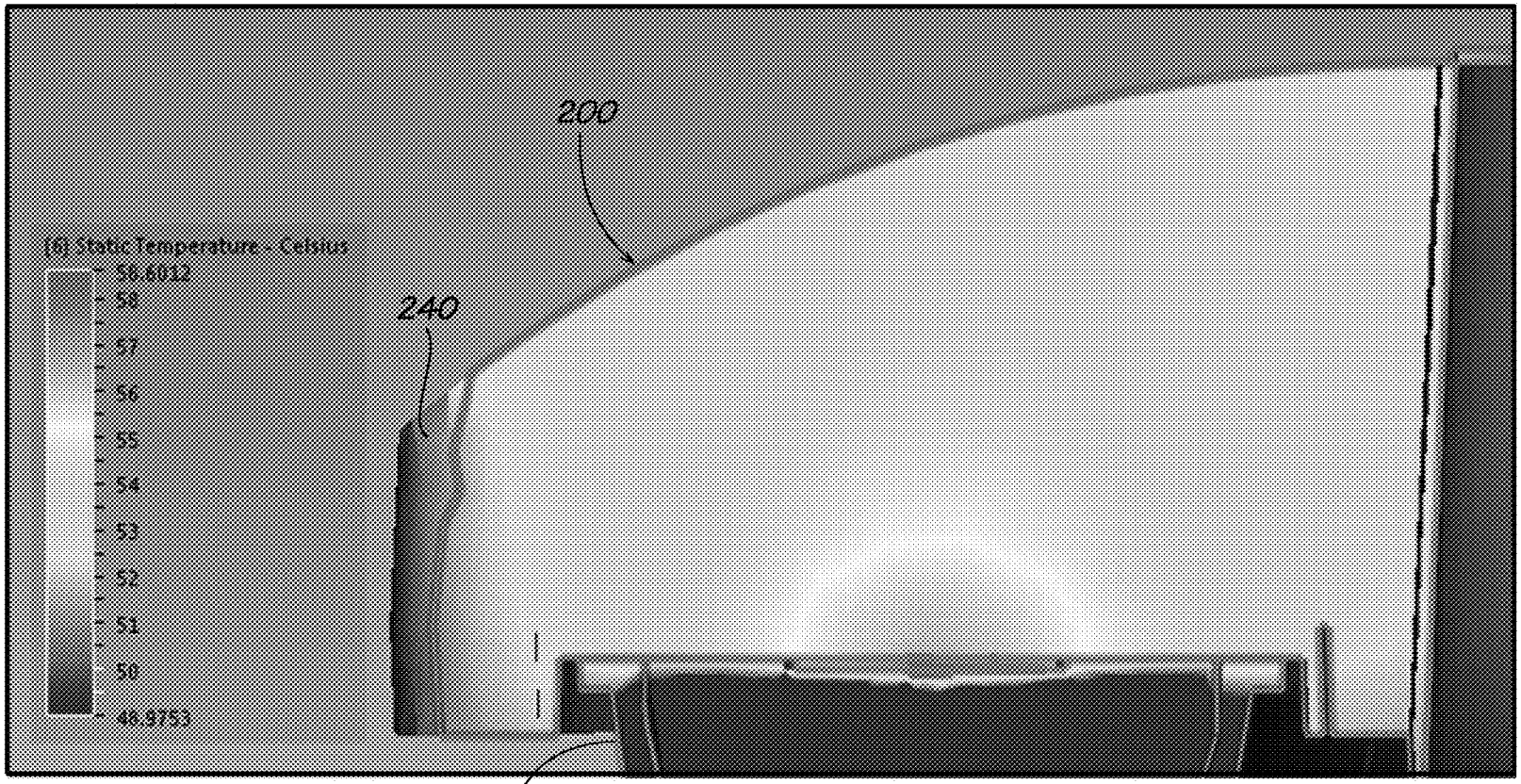
FIG. 9 is a computational fluid dynamics ("CFD") model showing temperature gradients in a LED luminaire according to certain features of the invention.

FIG. 9 shows a temperature gradient for a chassis 200 according to features of the invention. The temperatures on the chassis are highest where the LEDs are located. As shown, however, heat is conducted through the chassis (at least partially by way of the fins) to the outer surface of the chassis body, and in particular to outer perimeter vent 240 and inner perimeter vent 260, where air flowing through and/or around these vents will remove the heat generated by the LEDs by natural convection.

Figure 10:
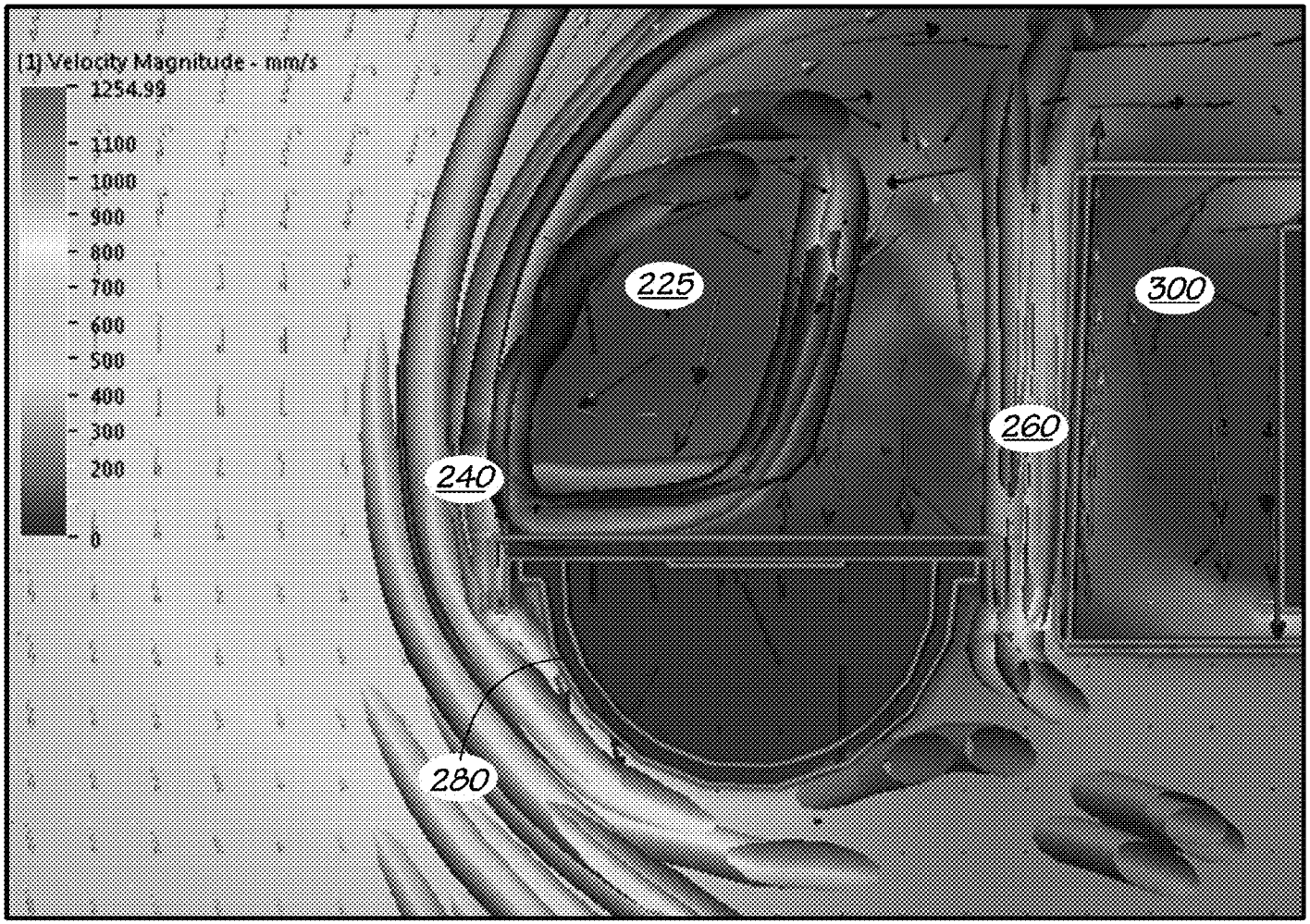
FIG. 10 is a CFD model showing air flow around and though a LED luminaire according to certain features of the invention.
Figure 11:
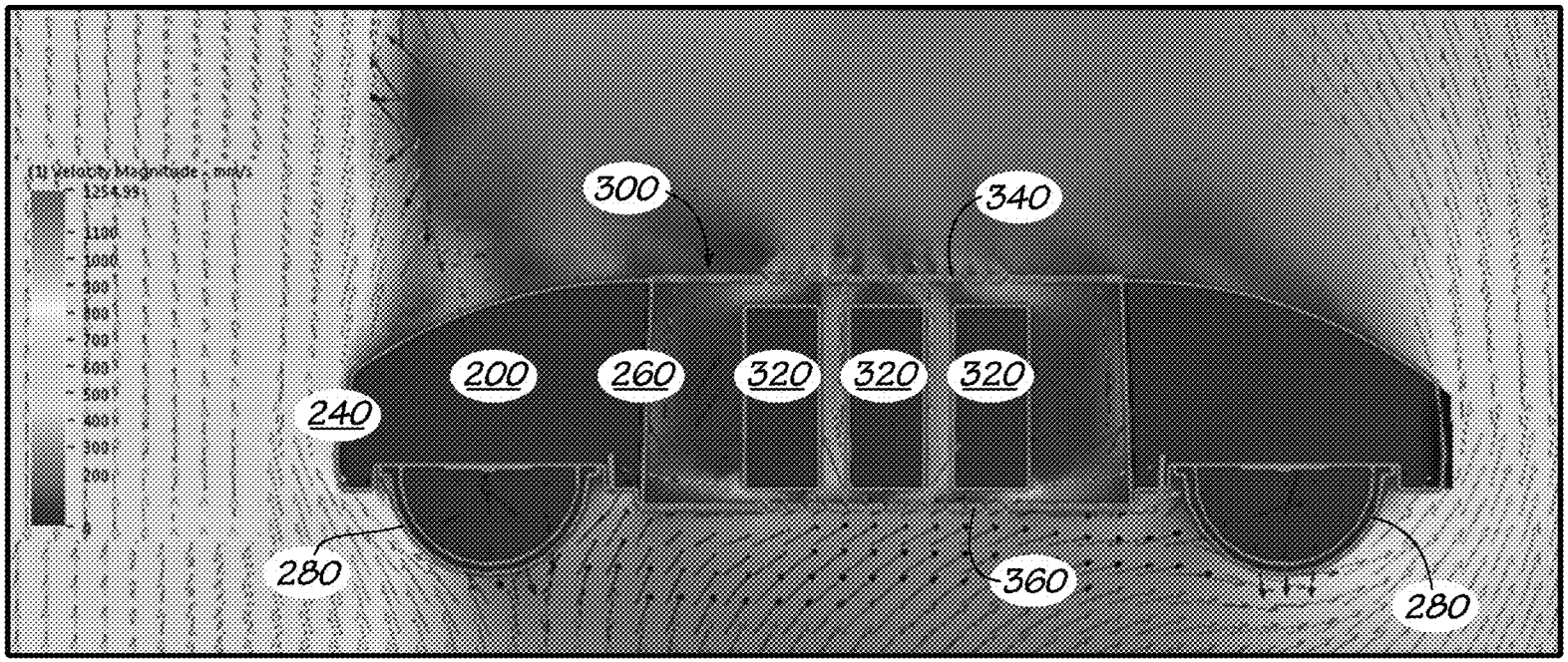
FIG. 11 is a CFD model showing air flow around through a LED luminaire according to certain features of the invention.

FIGS. 10 and 11 show relatively higher velocities around and/or through the outer perimeter vent 240 and inner perimeter vent 260 and past the LED power supply units (through the top vent cover 340 and bottom vent cover 360) and around the outside of the LED luminaire. In addition, FIG. 11 shows how the air flows around the curved optic 280 located on the bottom of the LED luminaire. This curving effect is known as the Coandă effect, resulting from the features of the invention described herein, including but not limited to the curved optic 280, outer perimeter vents 240 and inner perimeter vents 260. The Coandă effect contributes to improved heat transfer from the LED luminaire to ambient air. It is noted the LED luminaire depicted in the simulation shown in FIG. 11 included three LED power supply units 320, with air flowing between and around each.

In the CFD model simulation illustrated in FIG. 11, air started to accelerate past the optic 280, thus applying an air pressure to any dust particles which may be located thereon.

FIG. 10 also illustrates the circulation of air past the fins 225 on the chassis body and the Venturi effect as ambient air accelerates through the vents.

Figure 14:
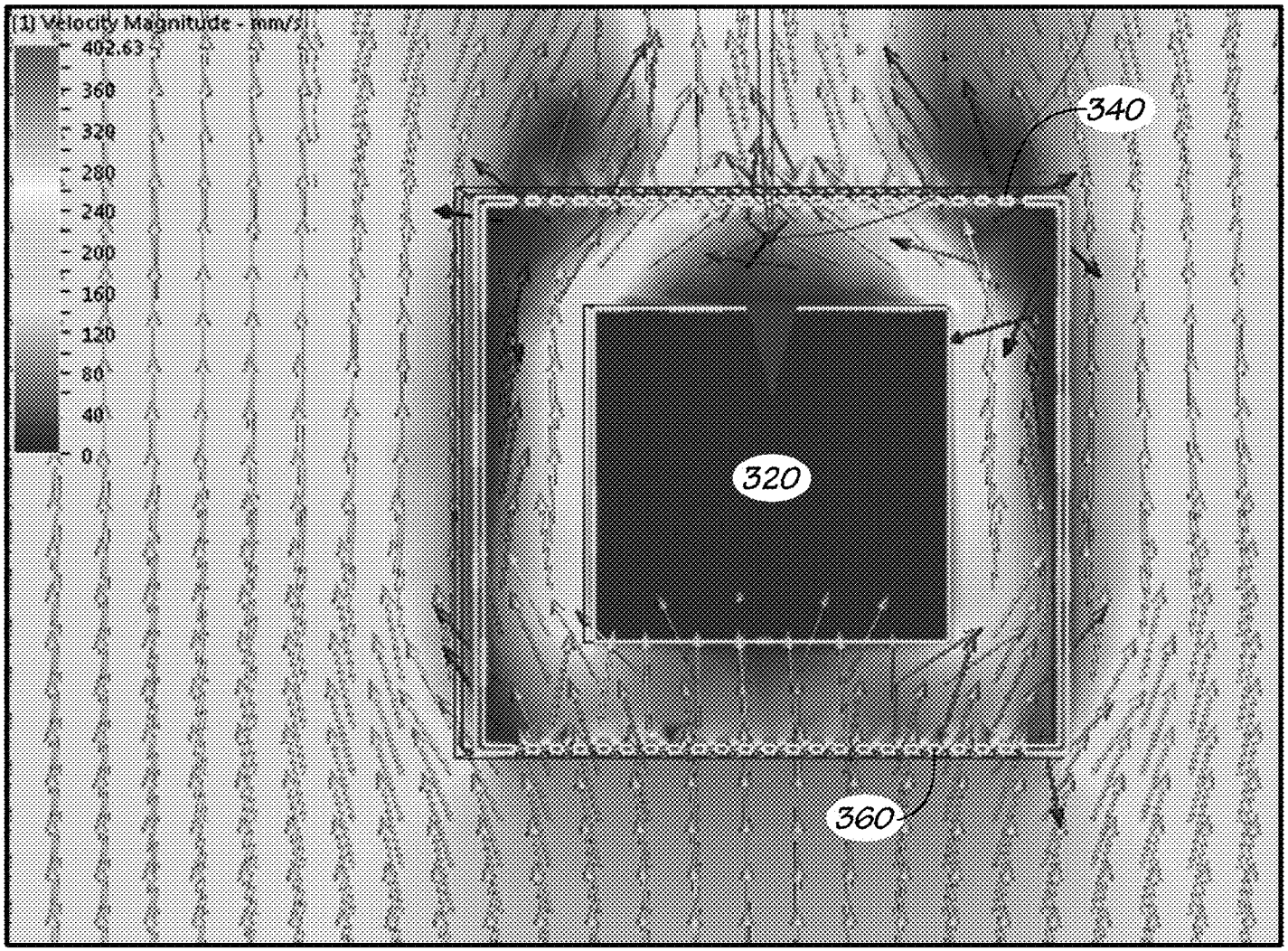
FIG. 14 is a CFD model showing air flow through and around a power supply assembly utilizing vertical ventilation according to certain features of the invention.

FIG. 14 shows a CFD model simulation of air flowing through a LED power supply assembly 300 and around a LED power supply unit 320 according to features of the invention. The air velocity past the LED power supply 320 in this simulation was approximately 240 mm/s.

Figure 12:
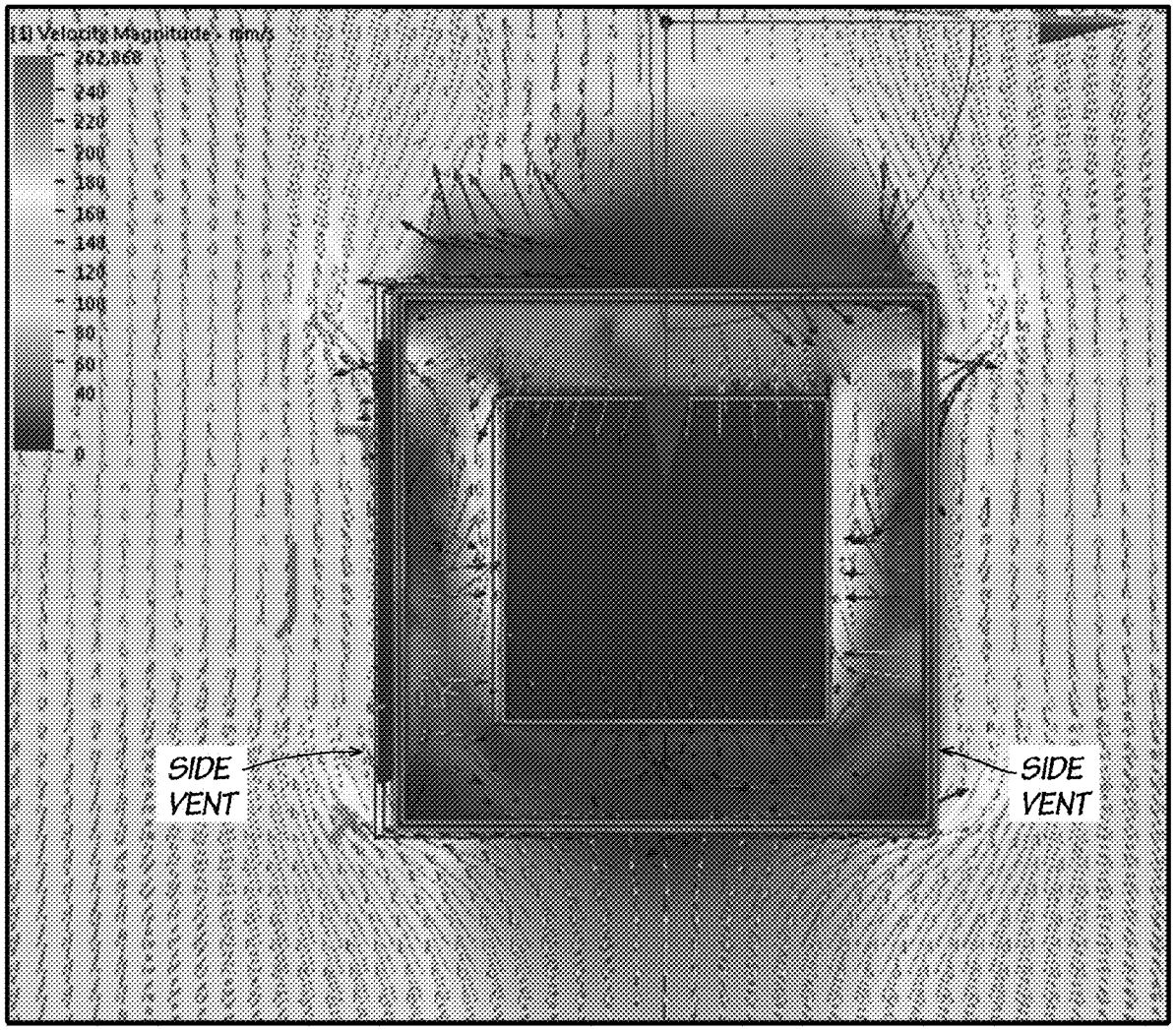
FIG. 12 is a comparative CFD model showing air flow through and around a power supply assembly utilizing horizontal ventilation.
Figure 13:
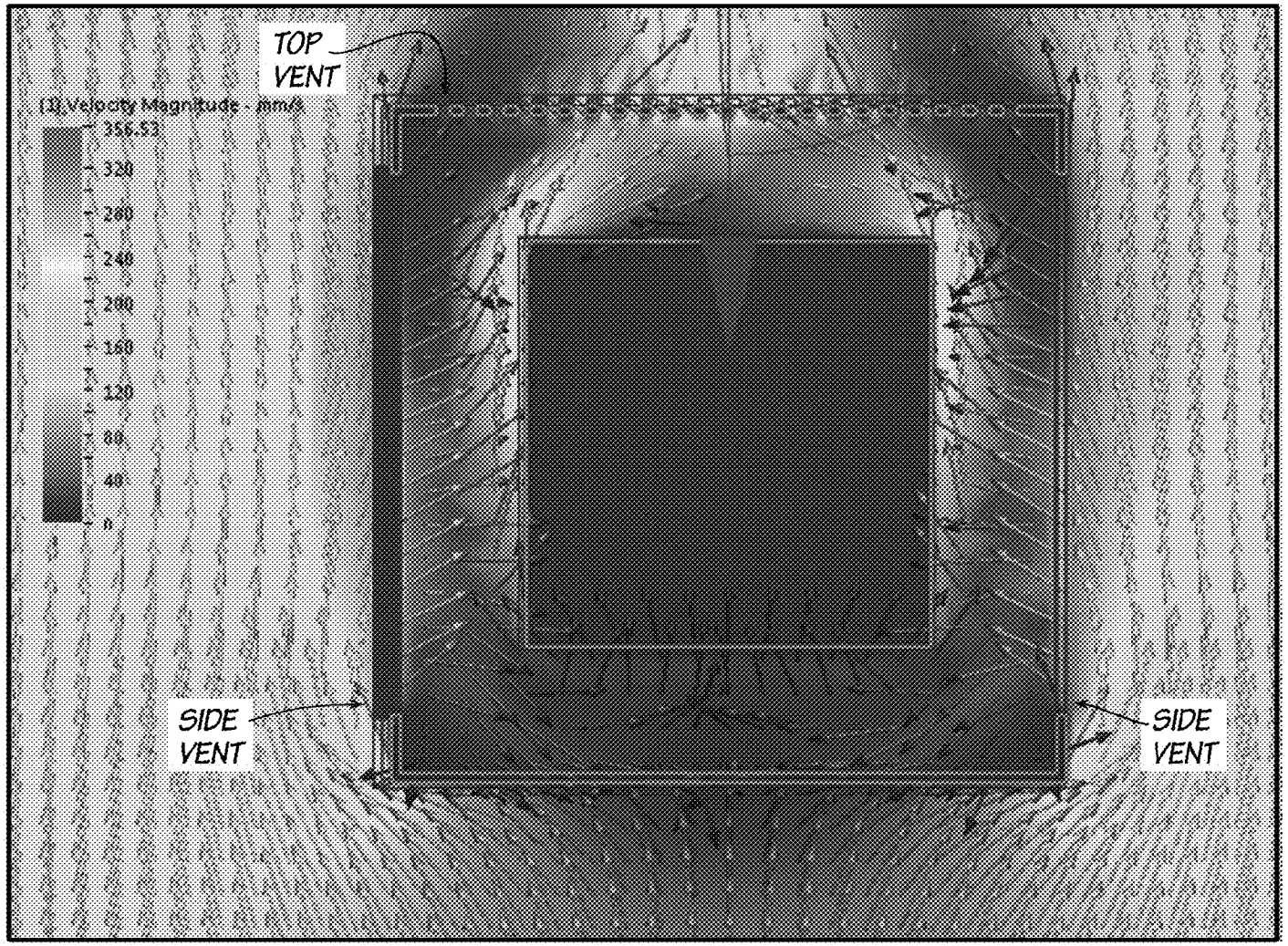
FIG. 13 is a comparative CFD model showing air flow through and around a power supply assembly utilizing side and top ventilation.

FIGS. 12 and 13 show CFD model simulations of comparative examples of an LED power supply assembly. In FIG. 12, the LED power supply assembly includes only side vents, while FIG. 13 shows an LED power supply assembly including two side vents and a top vent. Air velocity through these comparative LED power supply assemblies and past the LED power supply unit was approximately 140 mm/s and 180 mm/s, respectively.

The results depicted in FIGS. 12-14 are shown in the table provided below:

| Ventilation Configuration | Air Velocity Past LED Driver (mm/s) | Air Volumetric Flowrate Past LED Driver* ($cm^3$/min) | Increase as Compared to Horizontal Flow (%) |
|---|---|---|---|
| Horizontal (FIG. 12) | 140 | 504 | N/A |
| Horizontal-In/ Vertical-Out (FIG. 13) | 180 | 648 | 29 |
| Vertical | 240 | 864 | 71 |

*Volume/min calculated as Air Velocity × Cross Sectional Area around LED Driver

The following parameters were used for the simulations:

Compartment size: 150 mm×150 mm×150 mm

LED Driver Size: 90 mm×90 mm×90 mm

Ventilation Slot Area: 7920 $mm^2$

Ambient Temperature: 25° C.

LED Driver Internal Heat Generation: 10W

The results of the CFD simulations show that vertical ventilation helps to maximize the volume of available airflow in order to increase the effects of natural convection to remove the heat from the LED power supply unit/driver. Features of the invention thus provide approximately 71% more airflow volume than horizontal ventilation, resulting in a significant reduction in electronic LED power supply unit/driver temperature.

As explained above, the LED luminaire may have various shapes, including a semi-toroidal (donut), oval, square, rectangular or even triangular shape. Further, the opening towards the center of the chassis for receiving the LED power supply assembly may have a shape that is complementary and corresponds to that of the LED luminaire (e.g., round, oval, square, rectangular or triangular) or it could have a different shape than that of the overall LED luminaire (e.g., a semi-toroidal shaped LED luminaire with a square LED power supply assembly). It may be, however, that embodiments of the invention shown in the figures and described above (a semi-toroidal shaped LED luminaire having a semi-toroidal shaped chassis body 210, a segmented circular outer perimeter 213 and circular central opening 215 defining an inner perimeter 217) provide the most efficient and desirable circular symmetric light distribution.

The LED luminaire 100 may be configured to hang from a ceiling or other structure. In some embodiments, one end of a suspension apparatus, such as, but not limited to, a wire rope assembly 290 such as but not limited to a 4-2-1 wire rope system (four wires attached to the LED luminaire, two of the wires connected to a ring (for two rings), and one attachment point to the ceiling) may be attached to the LED luminaire. The other end of the suspension apparatus may be attached to the ceiling.

Different arrangements of the components depicted in the drawings or described above, as well as components and steps not shown or described are possible. Similarly, some features and subcombinations are useful and may be employed without reference to other features and subcombinations. Features of the invention have been described for illustrative and not restrictive purposes, and alternative features will become apparent to readers of this patent. Accordingly, the present invention is not limited to the features described above or depicted in the drawings, and various features and modifications can be made without departing from the scope of the claims below.

That which is claimed is:

1. A light-emitting diode (LED) luminaire comprising:

a. a chassis having an opening and comprising a chassis body having an inner perimeter and an outer perimeter, wherein a central axis of the chassis extends within the opening;

b. at least one LED module supported on the chassis body; and c. an LED power supply assembly comprising at least one LED power supply unit for the at least one LED lighting module, wherein the LED power supply assembly is positioned within the opening, wherein the chassis further comprises at least one inner perimeter vent extending along the inner perimeter of the chassis body and interposed between the at least one LED module and the LED power supply assembly, wherein the at least one inner perimeter vent comprises an inner perimeter vent axis extending substantially perpendicular to an opening of the inner perimeter vent and substantially parallel to the central axis of the chassis, and wherein the at least one inner perimeter vent is visible in a plan view of a light-emitting side of the chassis.

2. The LED luminaire according to claim 1, wherein the at least one inner perimeter vent comprises a plurality of inner perimeter vents extending along the inner perimeter of the chassis body.

3. The LED luminaire according to claim 1, wherein the chassis further comprises a plurality of outer perimeter vents extending along the outer perimeter of the chassis body.

4. The LED luminaire according to claim 3, wherein at least one of the outer perimeter or inner perimeter of the chassis body is circular.

5. The LED luminaire according to claim 3 wherein the at least one inner perimeter vent comprises a plurality of inner perimeter vents extending along the inner perimeter of the chassis body and wherein the chassis further comprises a plurality of fins located on the chassis body, each of the plurality of fins comprising a proximal end and a distal end, wherein the inner perimeter vents are formed by connecting the proximal ends of adjacent fins and the outer perimeter vents are formed by connecting the distal ends of adjacent fins.

6. The LED luminaire according to claim 3, wherein at least one of the plurality of outer perimeter vents comprises an outer perimeter vent axis substantially parallel to the inner perimeter vent axis.

7. The LED luminaire according to claim 1, wherein the LED power supply assembly further comprises a top vent cover located above the at least one LED power supply unit and a bottom vent cover located below the at least one LED power supply unit, wherein the top vent cover and bottom vent cover are vented so as to allow natural flow of air around the LED power supply assembly.

8. The LED luminaire according to claim 1, wherein the at least one LED lighting module comprises a plurality of LEDs mounted on at least one printed circuit board in an arc.

9. The LED luminaire according to claim 1, further comprising an optic positioned over the at least one LED lighting module, wherein the optic comprises a semi-torus shape.

10. The LED luminaire according to claim 1, wherein the chassis is semi-toroidal shaped and the opening is circular.

11. A light-emitting diode (LED) luminaire comprising:

a. a chassis comprising a chassis body;

b. at least one LED module mounted on the chassis body; and c. an LED power supply assembly comprising at least one LED power supply unit for the at least one LED lighting module, wherein the chassis body has an inner perimeter and an outer perimeter, and the chassis further comprises a plurality of inner perimeter vents interposed between the chassis body and the LED power supply assembly to thermally separate the chassis body from the LED power supply assembly, wherein the chassis further comprises a plurality of outer perimeter vents extending along the outer perimeter of the chassis body, wherein the chassis further comprises a plurality of fins located on the chassis body, each of the plurality of fins comprising a proximal end and a distal end, and wherein the inner perimeter vents are formed by connecting the proximal ends of adjacent fins and the outer perimeter vents are formed by connecting the distal ends of adjacent fins.

12. A light-emitting diode (LED) luminaire comprising:

a. a chassis comprising a chassis body;

b. at least one LED module mounted on the chassis body; and c. an LED power supply assembly comprising at least one LED power supply unit for the at least one LED lighting module, wherein the chassis body has an inner perimeter and an outer perimeter, and the chassis further comprises at least one inner perimeter vent interposed between the chassis body and the LED power supply assembly to thermally separate the chassis body from the LED power supply assembly, wherein the chassis further comprises a plurality of fins, each of the plurality of fins comprising a proximal end and a distal end, wherein the at least one inner perimeter vent is formed by connecting the proximal ends of adjacent fins, and wherein the at least one inner perimeter vent is visible in a plan view of a light-emitting side of the chassis.

13. The LED luminaire according to claim 12, wherein the chassis further comprises a plurality of outer perimeter vents extending along the outer perimeter of the chassis body.

14. The LED luminaire according to claim 13, wherein the outer perimeter vents are formed by connecting the distal ends of adjacent fins.

15. The LED luminaire according to claim 12, wherein the at least one inner perimeter vent comprises a plurality of inner perimeter vents located around the inner perimeter of the chassis body, and wherein each of the plurality of inner perimeter vents is formed by connecting the proximal ends of adjacent fins.

* * * * *